US007247228B2

(12) United States Patent
Dräger et al.

(10) Patent No.: US 7,247,228 B2
(45) Date of Patent: Jul. 24, 2007

(54) METHOD FOR PREPARING A CARRIER FOR A PHOTOCONDUCTOR FOR THE FORMATION OF AN ELECTROPHOTOGRAPHIC RECORDING ELEMENT AND A RECORDING ELEMENT FORMED ACCORDINGLY

(75) Inventors: Udo Dräger, Speyer (DE); Detlef Schulze-Hagenest, Molfsee (DE)

(73) Assignee: Eastman Kodak Company, Rochester, NY (US)

( * ) Notice: Subject to any disclaimer, the term of this patent is extended or adjusted under 35 U.S.C. 154(b) by 289 days.

(21) Appl. No.: 10/867,443

(22) Filed: Jun. 14, 2004

(65) Prior Publication Data

US 2005/0000822 A1 Jan. 6, 2005

(30) Foreign Application Priority Data

Jun. 16, 2003 (DE) ..... 103 27 315

(51) Int. Cl.
*G03G 5/04* (2006.01)

(52) U.S. Cl. ..... 205/229; 430/69; 430/131

(58) Field of Classification Search ..... 430/69, 430/127, 131; 205/229
See application file for complete search history.

(56) References Cited

U.S. PATENT DOCUMENTS

| | | | | |
|---|---|---|---|---|
| 2,297,691 | A | 10/1942 | Carlson | 95/5 |
| 4,152,152 | A | 5/1979 | Contois et al. | |
| 4,699,861 | A * | 10/1987 | Mizukami | 430/64 |
| 4,800,144 | A * | 1/1989 | Ueda et al. | 430/58.05 |
| 5,208,126 | A | 5/1993 | Tachikawa et al. | |
| 5,908,724 | A | 6/1999 | Matsui | |
| 6,022,589 | A | 2/2000 | Klosowski et al. | |
| 6,037,089 | A | 3/2000 | Yahagi et al. | |
| 6,051,148 | A | 4/2000 | Perry et al. | |
| 6,051,357 | A | 4/2000 | Matsui et al. | |
| 6,080,491 | A | 6/2000 | Takaki et al. | |
| 6,410,197 | B1 * | 6/2002 | Bellino et al. | 430/65 |
| 2003/0013030 | A1 * | 1/2003 | Yahagi et al. | 430/65 |

FOREIGN PATENT DOCUMENTS

| | | |
|---|---|---|
| DE | 3528428 C2 | 2/1988 |

* cited by examiner

*Primary Examiner*—John L Goodrow
(74) *Attorney, Agent, or Firm*—Lawrence P. Kessler

(57) ABSTRACT

A carrier or substrate for a photoconductor to be used for the formation of an electrophotographic recording element, particularly an imaging drum for an electrophotographic printing press, wherein the carrier is made of a metal or a metal alloy, preferably of aluminum, is prepared wherein the surface of the carrier supporting the photoconductor, used to form a barrier layer, is oxidized, preferably by etching and/or anodizing. The oxidized surface of the barrier layer is sealed with a sealing material following oxidation, and a preservative or impregnating agent is used as the sealing material.

6 Claims, 1 Drawing Sheet

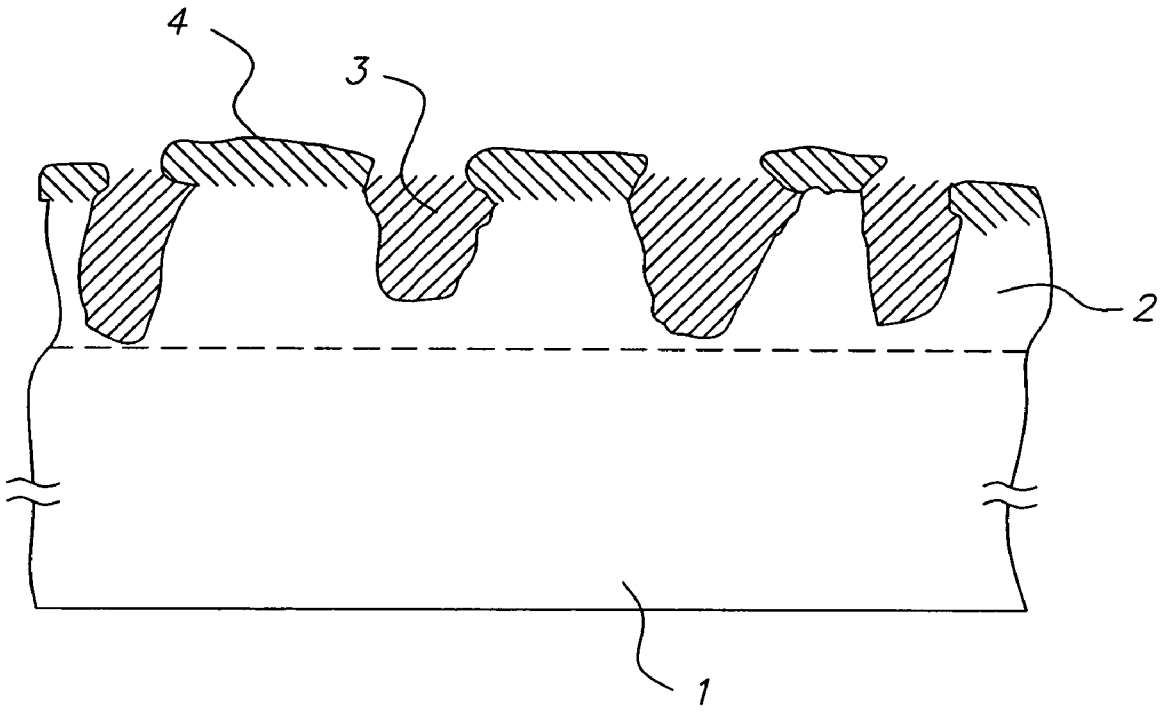
4
3
2
1

METHOD FOR PREPARING A CARRIER FOR A PHOTOCONDUCTOR FOR THE FORMATION OF AN ELECTROPHOTOGRAPHIC RECORDING ELEMENT AND A RECORDING ELEMENT FORMED ACCORDINGLY

FIELD OF THE INVENTION

The invention relates to an electrophotographic recording element, and a method for preparing a carrier or substrate for a photoconductor for the formation of an electrophotographic recording element, particularly, an imaging drum for an electrophotographic printing press, wherein the carrier is made of a metal or a metal alloy, preferably of aluminum, and the surface of the carrier supporting the photoconductor, which is used to form a barrier layer, is oxidized, preferably by etching and/or anodizing, preferably to a barrier layer thickness of approximately 0.05 μm to approximately 1.5 μm and wherein the oxidized surface of the barrier layer is sealed with a sealing material following oxidation.

BACKGROUND OF THE INVENTION

For the electrophotographic process, the formation of the photoconducting recording element, which can also be called photo carrier or imaging unit, is particularly important. The basic principle of electrophotography can hereby be taken from U.S. Pat. No. 2,297,691, issued on Oct. 6, 1942, in the name of Chester F. Carlson, wherein a metal plate, on which a thin layer made of a photoconducting insulating material was deposited, has been used as a recording element.

Today, the recording element can include, for example, a drum that has a body made of aluminum, or a flexible strip, each of which has a suitable photoconducting sheath or coating. For the formation of the photoconducting layer (photoconductor)to occur, essentially three possibilities are considered. First, the layer can include arsenic triselenide ($As_2Se_3$) or similar materials containing selenium. Second, an organic photoconductor (organic photoconductor OPC) is considered. Third, amorphous silicon can be used for the photoconductor (a-Si, or also called α-Si). A coating with an organic multi-layer system is the most widespread method for producing a photoconductor.

For example, a photo carrier with an OPC coating can be used, that is homogenously negatively chargeable. For the imaging of this homogenously charged photo carrier, the photo carrier is then exposed in an appropriate manner. The light is absorbed in a charge-generating base coat. Positive charges are thus generated, that, by a charge transport layer, compensate for the negative charge on the surface in the image areas exposed at any one time. When a—Si or selenium coating is used, the surface becomes positively charged. In comparison to OPC layers, coatings made of a—Si have a higher wear resistance, but are burdened with higher production costs. OPC coatings can also be improved by using wear-reducing coatings.

Single-layer photoreceptors require the photo-generation and transport of electrons and holes in the same layer.

A vapor-deposited, semi-permeable metal carrier, made, for example, of Al, Ni, or Cr on a polymer carrier, such as, polyethylene terephthalate, is used as the substrate for electrophotographic strips. Metal cylinders serve as electrodes for imaging drums or cylinders. Suitable collars are generally pulled or stretched across them.

Normally, a thin blocking layer is inserted between the electrodes and the photoreceptor, in order to prevent a charge injection. This blocking layer should not be so thick that a residual charge accumulates during the charging/discharging cycles. To avoid hysteresis effects, blocking layers are normally less than 1 μm thick. The purpose of the blocking layer is to reduce the rate of dark discharge, to increase charge acceptance, and prevent point injections that could lead to local defects in the final image. Numerous insulating polymers have already been used as a blocking layer, including: acrylic polymers, epoxide resins, polyamides, polyester, polyphosphazene, polysiloxane, polyurethane, polyvinyls, etc. Bonding agents, namely, those with unsaturated bonding for bonding metal and resin, can likewise be used.

A photoconductor, as described above, including a blocking layer that contains a resinous material, suffers from a relatively high residual charge, and therefore, from a relatively low photosensitivity. Toner particles consequently, tend to adhere to non-imaged areas that have no electrostatic latent image, so that defective images are created, namely, "fuzzy" images. Such a phenomenon is particularly observed at relatively low temperatures, and at a relatively low atmospheric humidity. For the elimination of such a phenomenon, an intermediate layer or a bottom layer that includes resinous material and has conducting particles or metal oxides has been recommended. Alternatively, a bottom layer can be formed, by applying an oxide film to the conducting substrate using anodic oxidation. This is frequently used in highly reliable photoconductors, since oxide films are at beneficially high temperatures and high atmospheric humidity. A conductive base can also be oxidized, and saturated in an electrolytic solution. An oxide film can subsequently be molded on the conductive base by etching, for example.

On the other hand, oxidized aluminum surfaces are not homogenous. They exhibit a typical, sponge-like, or crater-like microstructure. This surface structure in turn leads to charge injection and charge collapse, which cause image defects, particularly, if the thickness of the blocking layer (or "barrier layer") is significantly less than 1 μm.

A portion of a laser light used for imaging that falls onto a photoconductor, reaches the aluminum oxide film without being absorbed by a charge-generating layer. The light partially penetrates the oxide layer. The penetrated light is reflected at the boundary between the aluminum base and the aluminum oxide layer. A portion of the light does not penetrate the aluminum oxide film. This portion is reflected at the boundary between the charge-generating layer and the aluminum oxide film. Both reflected light portions have the same wavelength and are coherent. As a result, these light portions interfere with each other, which can lead to interference rings, depending upon variations in layer thickness. These types of interference rings lead to an irregular print density.

SUMMARY OF THE INVENTION

The underlying objective of the invention is to avoid the aforementioned problems, and particularly to reduce, point injections, hysteresis effects, dependence upon environmental conditions, especially moisture, and/or interference patterns.

According to the invention, a carrier or substrate for a photoconductor to be used for the formation of an electrophotographic recording element, particularly an imaging drum for an electrophotographic printing press, wherein the carrier is made of a metal or a metal alloy, preferably of aluminum, is prepared wherein the surface of the carrier supporting the photoconductor, that is used to form a barrier layer, is oxidized, preferably by etching and/or anodizing. The oxidized surface of the barrier layer is sealed with a sealing material following oxidation, and a preservative or impregnating agent is used as the sealing material.

BRIEF DESCRIPTION OF THE DRAWING

An embodiment of the invention, from which additional inventive features can also be derived, but to which the scope of the invention should not be limited, is shown in the drawing with a single FIGURE that depicts a layer structure according to the implementation of an embodiment of the method, according to the invention.

DETAILED DESCRIPTION OF THE INVENTION

In the FIGURE, a substrate 1, or a substrate layer made of aluminum, for example, of a photoconductor of a strip, of a cylinder, or of a collar, for instance, is depicted. This substrate 1 is initially oxidized, for example, by etching or anodizing, and is thus provided with an oxide layer 2 made of $Al_2O_3$, for example. As shown and described above, this inorganic blocking or barrier oxide layer 2, is non-homogenous and craterlike or cavernous. In order to level the craters in the oxide layer 2, the craters are preferably filled with a cold water-based impregnating agent 3 that is used, for example, for the conservation of archeological findings, particularly those findings made of wood, as disclosed in U.S. Pat. No. 6,022,589, issued on Feb. 8, 2000, in the name of Jerome M. Klosowski et al.

Subsequently, for additional oxidation, the surface that is filled with the impregnating agent 3 is rinsed with preferably, warm water that is enriched with ozone ($O_2$ and/or $O_3$), so that additional oxidation areas 4 are created on the surface, that especially compact or further seal the edges of the filled craters.

Specifically, for the formation of the filling 3 of the craters, a melamine resin and/or aminoplastic resin is used as the preservative. An annealable polymer system containing siloxane, silane and/or mixtures of siloxane or silane, or of silone and silane, is used as the impregnating agent. The impregnating agent contains a cross-linking agent. For oxidizing the carrier surface, at least one method is selected from the following methods: polyethylene-glycol method, sucrose method, acetone-rosin method, alcohol-ether method, camphor-alcohol method, or silicone oil treatment.

Prior to rinsing the surface for the formation of the additional oxidations 4 and after completing the filling of the craters, the surface should be carefully cleaned, for example, wiped off, in order to avoid adhesions of impregnating agents on the surfaces in the areas 4 that are to be further oxidized.

The invention has been described in detail with particular reference to certain preferred embodiments thereof, but it will be understood that variations and modifications can be effected within the spirit and scope of the invention.

What is claimed is:

1. Method for preparing a carrier or substrate for a photoconductor for the formation of an electrophotographic recording element, particularly an imaging drum for an electrophotographic printing press, wherein the carrier is made of a metal or a metal alloy, preferably of aluminum, the method comprising the steps of: oxidizing the surface of the carrier supporting the photoconductor that is used to form a barrier layer, etching and/or anodizing, preferably to a barrier layer thickness of approximately 0.05 μm to approximately 1.5 μm, and following oxidation, sealing the oxidized surface of the barrier layer with a cold, water-based sealing material, including a melamine resin and/or aminoplastic resin as a preservative or impregnating agent.

2. Method according to claim 1, characterized by, oxidizing the carrier surface, at least one method is selected from the following methods: polyethylene-glycol method, sucrose method, acetone-rosin method, alcohol-ether method, camphor-alcohol method, or silicone oil treatment.

3. Method according to claim 1, further including the step of cleaning the oxidized surfaces after they are sealed.

4. Method according to claim 3, after sealing and, if necessary after cleaning, re-oxidizing the oxidized surface.

5. Method according to claim 4, characterized by using warm water for re-oxidation.

6. Method according to claim 5, characterized by the warm water being enriched with $O_2$ and/or $O_3$.

* * * * *